US005342717A

United States Patent [19]

Su et al.

[11] Patent Number: 5,342,717

[45] Date of Patent: Aug. 30, 1994

[54] CHARGING COMPONENT FOR ELECTROPHOTOGRAPHIC PROCESS CONTAINING A PROTECTIVE LAYER OF CONDUCTIVE CARBON BLACK PARTICLES IN POLYETHER-ESTER-AMIDE BLOCK COPOLYMER

[75] Inventors: Der-Tarng Su, Hsinchu; Wen-Jer Chen, Kaohsiung; Jeng-Yue Wu, Hsinchu; Ming-Chu Wu, Kaohsiung, all of Taiwan

[73] Assignee: Industrial Technology Research Institute, Hsinchu, Taiwan

[21] Appl. No.: 12,913

[22] Filed: Feb. 3, 1993

[51] Int. Cl.[5] ..... G03G 13/02

[52] U.S. Cl. ..... 430/55; 430/937; 428/213

[58] Field of Search ..... 430/937, 55; 428/213

[56] References Cited

U.S. PATENT DOCUMENTS 4,649,097 3/1987 Tsukada et al. ..... 430/937
5,069,955 12/1991 Tse et al. ..... 428/213

FOREIGN PATENT DOCUMENTS 50-13661 5/1975 Japan .
58-150975 9/1983 Japan .
1205180 8/1989 Japan .

*Primary Examiner*—John Goodrow

[57] ABSTRACT

A direct contact type charging component for use in electrophotographic process containing a protective surface layer which comprises a polyether-ester-amide block copolymer. The copolymer is environmentally stably having a volume resistivity between $10^6$ Ohm-cm and $10^{12}$ Ohm-cm and a Shore hardness between Shore D 5 and Shore D 90. During the electrophotographic process, a voltage is applied externally to the charging component to cause a charged component, which typically comprises a photo-conductive drum, to become electrostatically charged. In the preferred embodiment, the voltage consists of a direct voltage of ±200 to ±2,000 V overlapped with an alternating voltage having a peak-to-peak voltage of 4,000 V.

14 Claims, 1 Drawing Sheet

CHARGING COMPONENT FOR ELECTROPHOTOGRAPHIC PROCESS CONTAINING A PROTECTIVE LAYER OF CONDUCTIVE CARBON BLACK PARTICLES IN POLYETHER-ESTER-AMIDE BLOCK COPOLYMER

FIELD OF THE INVENTION

This invention relates to a charging component. More particularly, this invention relates to a direct contact type charging component for use in electrophotographic process to cause a charge receiving component, or the so-called charged component, to become electrostatically charged.

BACKGROUND OF THE INVENTION

In a conventional electrophotographic process, high voltage (5,000–8,000 volt DC) is applied to a metal wire to produce a corona discharge, which, in turn, causes a photo-conductive drum to become charged. In this conventional process, the metal wire is the "charging" component, and the photo-conductive drum is the charging receiving or "charged" component. Because of the high voltage involved in the conventional charging process, undesirable side products such as $O_3$ and $NO_x$ are often produced during the corona discharge which could degenerate the surface of the photoconductive drum. When the surface of the photo-conductive drum becomes degenerated, the print image produced from the electrophotographic process becomes blurred and its quality deteriorated. Also, the surface of the metal wire used in the conventional electrophotographic process often becomes contaminated with impurities which could also result in deteriorated quality in the print images. As the trend in the electrophotographic process is to use photo-conductive drums containing organic photo-conductive material, the organic photo-conductive material can easily react with some of the reactive materials generated during the corona discharge. This also causes the image quality to degrade. Another disadvantage of the conventional electrophotographic process is that most of electrical current is lost to the shield grid behind the photo-conductive drum, only 5–30% of the current from the corona discharge is received by the photo-conductive drum, thus resulting in a relatively low charging efficiency.

In Jpn. Kokai Tokyo Koho JP.58-150975 (the '975 reference), it is disclosed a direct contact type charging component which causes a charged component, which is a photo-conductive drum, to become charged via direct contact therebetween. In the '975 reference, the charging component is a cylindrical roller which comprises a metal core enclosed by an electrically conductive rubber material containing electrically conductive carbon black particles which arc dispersed within the rubber matrix. The direct contact charging component design of the '975 reference was intended to avoid the aforementioned problems associated with the conventional charging component using the corona discharge method; however, it also suffered from other problems. Most notably, a significant portion of the rubber matrix becomes abraded due to frictional loss resulting from constant direct contact between the charging component and the charged component. When the extent of abrasion exceeds a certain level, some of the carbon black particles would become protruded and cause the photoconductive drum to be scratched and thus damaged. A damaged surface of the photo-conductive drum would produce defective images such as striation.

Several polymeric materials have been used to form a protective surface layer for the direct contact type charging components. Jpn. Kokai Tokyo Koho Jp.50-13661 ('661 reference) discloses a charging component which comprises a charging roller enclosed by a surface layer made of polyamide or polyurethane. Such a protective surface layer minimizes some of the abrasion problems of the direct contact charging component disclosed in the '975 reference. However, the polyamide and polyurethane surface layer was found to be environmentally unstable. In particular, the volume resistivity of the polyamide and polyurethane surface layer at low temperature and low humidity conditions can be about three orders of magnitude greater than that at normal conditions. The charging capacity of a charging component substantially decreases if the volume resistivity thereof is too high. The high volume resistivity of a charging component could also result in non-uniform charging. In an electrophotographic process utilizing the discharged area development (DAD) technique, the non-uniform charging causes spotty images to be generated.

The high volume resistivity of the surface layer also necessitates a high-voltage charging condition. Upon direct contact between the charging component and the charged component, any defect in the charged component could cause a discharge breakdown, resulting in a non-uniform charge density on the surface of the charged component. During electrostatic charging, the point of defect becomes the point of leakage by which the point of discharge breakdown serves as a electrostatic sink into which excess current flows from the charging component. Such a current drainage results in a lowered electric potential elsewhere, and, consequently, a region of deficient charging is developed in the charged component. When this occurs, a white band will appear if the print image is produced using the charged area development process. On the other hand, a back band will appear if the discharged area development process is used to produce the print image. Another disadvantage of the surface layer disclosed in the '661 reference is that the high hardness of the Nylon or polyurethane-based surface layer on the charging component could cause damages to the photo-conductive drum.

In Jpn. Kokai Tokyo Koho Jp. 1-205180 (the '180 reference) a charging component containing a surface layer containing N-alkoxyl-methylated Nylon is disclosed. The manufacturing of the N-alkoxyl-methylated Nylon involves a relatively complex process and the cost of manufacturing thereof is high. Furthermore, because of the high hardness of the N-alkoxyl-methylated Nylon, a lining layer comprising a relatively soft rubber material is often required underneath the surface layer to prevent damage to the photo-conductive drum. This further adds to the cost of using the N-alkoxyl-methylated Nylon disclosed in the '180 reference.

SUMMARY OF THE PRESENT INVENTION

The primary object of the present invention is to provide a charging component for use in an electrophotographic process that eliminates the aforementioned problems existing in the prior art. More particularly the primary object of the present invention is to provide a direct contact type charging component for use in an electrophotographic process which can cause a charged component such as a photo-conductive drum to become charged in a desirably uniform manner over a wide range of operating conditions via direct contact therebetween.

The charging component disclosed in the present invention comprises a protective surface layer having an appropriate degree of softness and hardness combination; therefore, it will not cause damages to the surface of the charged component. Furthermore, the surface layer of the present invention is environmentally stable; thus, it is competent in providing low volume resistivity even at low temperature and low humidity conditions. Consequently, the charging component of this invention minimizes the occurrence of non-uniform charging and guarantees high quality of produced images over a large number of repeated applications.

The present invention discloses an improved charging component which contains a surface layer thereof comprising an environmentally stable polyether-ester-amide block copolymer having a preferred hardness. The polyether-ester-amide block copolymer of the present invention is represented by the following formula:

$$HO\left[\underset{\underset{O}{\|}}{C}-PA-\underset{\underset{O}{\|}}{C}-O-PE-O\right]_n H$$

wherein n is an integer; PA represents a polyamide chain which can be Nylon 4-6, Nylon 6-9, Nylon 6-10, Nylon 6-12, Nylon 6, Nylon 11, or Nylon 12; and PE represents a polyether chain which can be polyether diol, polypropyl glycol, polyethylene glycol, polytetramethylene glycol, polycaprolactone diol, or polycarbonate diol. The polyamide chain imparts hardness to the copolymer; whereas, the polyether chain imparts softness thereto. Collectively, they provide the desired hardness/hardness combination. The block copolymer disclosed in the present invention can be dissolved in low-molecular weight alcohols, such as methanol, ethanol, and isopropanol, or low-molecular weight ketones, such as acetone and butanone. One of the advantages of the present invention is that the polyether-ester-amide block copolymer is soluble in many solvents which will not dissolve the rubber material that forms the conductive base layer of the charging component.

The surface layer of the charging component of the present invention can contain other polymers, such as Nylon 6, Nylon 66, Nylon 6-10, Nylon 11, or Nylon 12, which are also soluble in alcohols or ketones mentioned above. The amount of these polymer additives should, however, be limited so that the volume resistivity, the environmental stability, and the hardness of the charging component are within a desired range.

The hardness of the polyether-ester-amide block copolymer of the present invention has a Shore hardness of Shore D 5 to Shore D 90, preferably in the range of Shore D 10 to Shore D 50. The surface layer should be hard enough so it can resist abrasion to prevent the protrusion of carbon black particles dispersed therewithin. Yet, the surface layer should maintain enough softness so that it will not cause damages to the surface of the charged component upon direct contact therebetween.

The polyether-ester-amide block copolymer of the present invention exhibits excellent environmental stability. The environmental stability of the block copolymer is illustrated by its nearly constant volume resistivity, especially at low temperature and low humidity conditions (15° C. and 15% relative humidity). Such an environmental stability ensures a stable charging capability of the charging component and eliminates the occurrence of non-uniform charging condition on the charged component. The polyether-ester-amide block copolymer of the present invention also provides a low volume resistivity surface layer at $10^6$–$10^{12}$ Ohm-cm, preferably at $10^8$–$10^{11}$ Ohm-cm. The low volume resistivity of the polyether-ester-amide block copolymer of the present invention allows the charging process to be effectuated at a favorable low voltage condition which prevents the occurrence of image defects caused by the discharge breakdown in the charged component.

The lower volume resistivity of the block copolymer permits a low voltage environment in charging the charged component so that the occurrence of discharge breakdown and image defect can be avoided. Another advantage of the low voltage charging environment is that production of undesirable side products such as $O_3$ or $NO_x$ can be prevented. These products, which are often produced during high-voltage charging conditions, cause damages to the photo-conductive material, especially those of the organic type, and result in blurred images.

With the present invention, the charging process can be accomplished using a low voltage direct current or, preferably, an overlapping current comprised of a direct current overlapped with an alternating current. When an overlapping current is used, it is preferred that the direct current has a voltage of ±200 V to ±2,000 V, and that the peak-to-peak valve of the alternating current is less than 4,000 V.

BRIEF DESCRIPTION OF THE DRAWINGS

The objects and advantages of this invention will become more apparent upon reading the following detailed description and upon reference to the drawings in which.

DESCRIPTION OF PREFERRED EMBODIMENT

Figure 1:
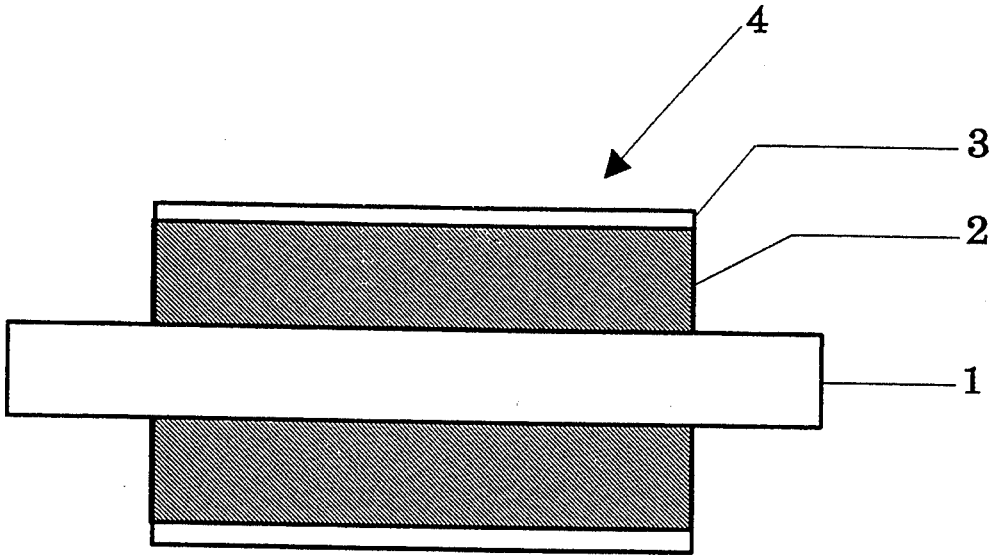
FIG. 1 is an axial cross-section of a charging component according to a preferred embodiment of the present invention.

Now referring to the Figures. In FIG. 1, it is shown an axial cross-section of a charging component according to a preferred embodiment of the present invention. The conductive base 1 typically has a multiple-layered structure. However, such a multiple-layered structure is not explicitly shown in FIG. 1. Typically, the conductive base 1 has a roller or cylindrical shape. However, it can be of any shape if necessary and/or desirable. Layer 2 is a conductive polymer base layer; it comprises primarily a conductive polymer such as polyacetylene, polypyrrole, polythiophene, or other conductive material containing conductive carbon black particles. The conductive polymer composition was applied via a dip coating or spray coating technique on the outer periphery of the conductive base 1 to form an outer layer enclosing the same. Other appropriate means can also be used to form the conductive polymer base layer 2. The conductive base 1, which is enclosed by the conductive polymer base layer 2, is made of a metal core, such as copper core, steel core, stainless steel core, or any other appropriate metal core. Layer 3, which comprises the polyether-ester-amide o block copolymer of the present invention, is a surface layer adjacent to and radially outwardly of the conductive polymer base layer 2. The volume resistivity of layer 2 is preferably less than that of the surface layer 3. Preferably the volume resistivity of layer 2 is approximately $10^0$–$10^{11}$ Ohm-cm, or more preferably $10^2$–$10^{10}$ Ohm-cm. The thickness of the surface layer 3 is designed to be approximately 5–300 μm preferably between 20–200 μm .

Figure 2:
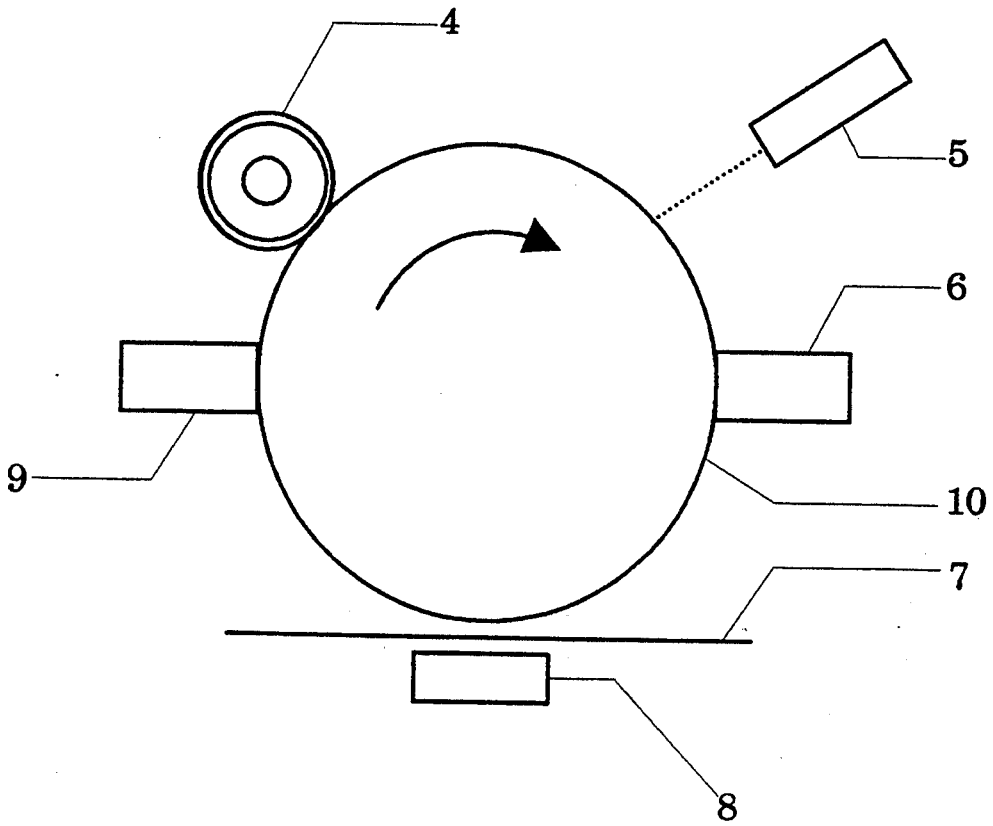
FIG. 2 is a schematic diagram of an electrophotographic process utilizing the charging component of the present invention.

FIG. 2 shows a schematic diagram of an electrophotographic, or electro-imaging, process in which the charging component was utilized. In FIG. 2, it is shown a charging component, which is a primary charging roller, 4, an exposure component 5, a charged component, which is a photo-conductive drum, 10, an image transfer component 8, and a cleaning component 9. Components 4, 5, 6, 8, 9 are all disposed about the photo-conductive drum 10. The exposure component emits laser light onto the photo-conductive drum 10. An image receiving medium such as a sheet of paper 7 is disposed between the photo-conductive drum 10 and the image transfer component 8 to receive developer powder from the charged component.

During the electrophotographic operation utilizing the charging component of the present invention, a voltage is applied externally to the primary charging roller 4. Upon direct contact between the primary charging roller 4 and the photo-conductive drum 10, the surface of the photo-conductive drum 10 becomes electrostatically charged. The exposure component 5 projects an image in the form of a bundle of laser light rays onto the surface of the photo-conductive drum 10 to cause the formation of an electrostatic latent image thereon. The developer supply component 6 provides a source of developer powder which can be absorbed electrostatically by the photo-conductive drum 10. The developer powder converts the electrostatic latent image into a positive visible image. The image transfer component 8 then transfers the developer powder image from the photo-conductive drum 10 to the image receiving medium 7 to form a positive printed image thereon. The cleaning component 9 recovers the residual developer powder from the photo-conductive drum 10.

The charging component 4 of the present invention can be fixed in space or rotatable in a reverse direction relative to the photo-conductive drum 10. The charging component 4 can optionally be provided with a cleaning function that can clean the residual developer powder left on the photo-conductive drum 10.

Several options can be employed to apply the voltage to the charging component 4 of the present invention. One method is to apply the voltage in an instant manner. Another method is to increase the voltage in a step-wise manner. If an overlapping current is to be applied, it may be desirable to alternate the overlapping current with an alternating current, i.e., the voltage is applied in the following sequence: alternating current, overlapping current, then alternating current.

The charging component of the present invention can be utilized with essentially any exposure component, any image transfer means or any cleaning component that has been disclosed in the prior art related to electrophotographic process, or any of the same yet to be disclosed in the future. A wide variety of developer powders and photo-conductors can be used in conjunction with the charging component of the present invention. The charging component disclosed in the present invention can be utilized in copiers, typesetters, laser printers, CRT printers, and facsimile machines, etc., that utilize the electrophotographic process.

The following examples provide detailed descriptions of preparing a charging component using the polyether-ester-amide block copolymer composition disclosed in the present invention and those of the prior art. Test results from these examples were compared to show the superior quality of the present invention for use in the electrophotographic process.

EXAMPLE 1

A blend containing conductive carbon black particles (15 parts by weight) and nitrile rubber (85 parts by weight) was compounded and formed into a roller shape. This blend became the conductive polymer base layer and a metal core was inserted therethrough to form a primary charging roller. The primary charging roller has a dimension of 12 (diameter) by 200 (length) mm. The volume resistivity of the primary charging roller was measured at 20° C. and a relative humidity of 77% to be $7\times10^3$ Ohm-cm.

A polyether-ester-amide block copolymer disclosed in the present invention (7 parts by weight) having a Shore hardness of Shore D 25 (using ASTM D2240 method, measured at 23±2° C. and 50±5% RH) was dissolved into ethanol (93 parts by weight) to form a mixture. The polyether-ester-amide block copolymer was purchased from ATO Chemicals of France, it was tested to have a relative viscosity of 1.9, measured in m-cresol at a concentration of 0.5 g/dl and a temperature of 30° C. Conductive carbon black particles (0.25 parts by weight) was added to the mixture. The mixture was stirred until the copolymer solutes were completely dissolved and the carbon black particles were evenly dispersed. The solution was then applied onto the conductive polymer base layer of the primary charging roller via a dip coating technique to form a surface layer thereon. After the surface layer was dried, the thickness thereof was measured to be 120 μm.

In one set of tests the primary charging roller was installed in a laser printer (HP II Laser Jet) replacing a commercial discharged area development type charging roller. The dark potential and the light potential of the primary charging roller were measured, respectively, under a −540 V direct voltage overlapped with a peak-to-peak alternating voltage of 2000 V. In order to evaluate the effect of defect on the print image, a 1 mm pin-hole was drilled on the photo-conductive drum. Tests were conducted both at the normal temperature and normal humidity condition (23° C. and 65% RH) and at a reduced temperature and humidity condition (15° C. and 15% RH).

In another set of tests, the coating solution so prepared was also coated on an aluminum foil to allow for the measurement of volume resistivity thereof.

Comparative Example 1

The primary charging roller was prepared using a procedure identical to that described in Example 1, except that a different coating composition was used to form the surface layer. Nylon 6-12 copolymer (7 parts by weight) was dissolved into ethanol (93 parts by weight) to form a mixture. Conductive carbon black particles (0.25 parts by weight) were added to the mixture. The mixture was stirred until the Nylon 6-12 solutes were completely dissolved and the carbon black particles were evenly dispersed. The solution was then applied onto the conductive polymer base layer of the primary charging roller via a dip coating technique to form a surface layer thereon. After the surface layer was dried, the thickness thereof was measured to be 120 μm.

The primary charging roller prepared here was installed in a laser printer (HP II Laser Jet) replacing a commercial discharged area development type charging roller. The dark potential and the light potential of the primary charging roller were measured, respectively, under a −540 V direct voltage overlapped with an alternating voltage having a peak-to-peak value of 2000 V. A 1 mm pin-hole was drilled on the photo-conductive drum to evaluate the effect of defect on the print image. Tests were conducted both at normal temperature and humidity condition (23° C. and 65% RH) and at a reduced temperature and humidity condition (15° C. and 15% RH). The coating solution so prepared was also coated on an aluminum foil to measure its volume resistivity thereof.

Comparative Example 2

The primary charging roller was prepared using a procedure identical to that described in Example 1, except that a different coating composition was used to form the surface layer. Nylon 6-66-612 copolymer (7 parts by weight) was dissolved into ethanol (93 parts by weight) to form a mixture. Conductive carbon black particles (0.25 parts by weight) were added to the mixture. The mixture was stirred until the Nylon 6-66-612 solutes were completely dissolved and the carbon black particles were evenly dispersed. The solution was then applied onto the conductive polymer base layer of the primary charging roller via a dip coating technique to form a surface layer thereon. After the surface layer was dried, the thickness thereof was measured to be 120 μm.

The primary charging roller prepared here was installed in a laser printer (HP II Laser Jet) replacing a commercial discharged area development type charging roller. The dark potential and the light potential of the primary charging roller were measured, respectively, under a −540 V direct voltage overlapped with an alternating voltage having a peak-to-peak value of 2000 V. A 1 mm pin-hole was drilled on the photo-conductive drum to evaluate the effect of defect on the print image. Tests were conducted both at the normal temperature and humidity condition (23° C. and 65% RH) and at a reduced temperature and humidity condition (15° C. and 15% RH). The coating solution so prepared was also coated on an aluminum foil to measure the volume resistivity thereof.

Comparative Example 3

The primary charging roller was prepared using a procedure identical to that described in Example 1, except that a different coating composition was used to form the surface layer. Epichlorohydrolrin rubber (7 parts by weight) and conductive carbon black particles (0.25 parts by weight) were added to butanone (93 parts by weight) to form a mixture solution. The solutes in mixture solution was dispersed using a ball mill. The solution was then applied onto the conductive polymer base layer of the primary charging roller via a dip coating technique to form a surface layer thereon. After the surface layer was dried, the thickness thereof was measured to be 90 μm.

The primary charging roller prepared here was installed in a laser printer (HP II Laser Jet) replacing a commercial discharged area development type charging roller. The dark potential and the light potential of the primary charging roller were measured, respectively, under a −540 V direct voltage overlapped with an alternating voltage having a peak-to-peak value of 2000 V. A 1 mm pin-hole was drilled on the photo-conductive drum to evaluate the effect of defect on the print image. Tests were conducted both at the normal temperature and humidity condition (23° C. and 65% RH) and at a reduced temperature and humidity condition (15° C. and 15% RH). The coating solution so prepared was also coated on an aluminum foil to allow for the measurement of volume resistivity thereof.

Comparative Example 4

The primary charging roller was prepared using a procedure identical to that described in Example 1, except that a different coating composition was used to form the surface layer. Chloroprene rubber (7 parts by weight) and conductive carbon black particles (0.25 parts by weight) were added to chloroform (93 parts by weight) to form a mixture solution. The solutes in mixture solution was dispersed using a ball mill. The solution was then applied onto the conductive polymer base layer of the primary charging roller via a dip coating technique to form a surface layer thereon. After the surface layer was dried, the thickness thereof was measured to be 90 μm.

The primary charging roller prepared here was installed in a laser printer (HP II Laser Jet) replacing a commercial discharged area development type charging roller. The dark potential and the light potential of the primary charging roller were measured, respectively, under a −540 V direct voltage and an alternating voltage having a peak-to-peak value of 2000 V. A 1 mm pin-hole was drilled on the photo-conductive drum to evaluate the effect of defect on the print image. Tests were conducted both at normal temperature and humidity condition (23° C. and 65% RH) and at reduced temperature and low humidity condition (15° C. and 15% RH). The coating solution so prepared was also coated on an aluminum foil to allow for the measurement of volume resistivity thereof.

Table 1 summarizes results of tests from the above examples. The charging component of Example 1 exhibited an essentially constant volume resistivity and light and dark potentials at the two conditions tested. Table 1 also showed that no striation was observed from the charging component of Example 1, and that the pin-hole did not affect the print image. Furthermore, because the charged component was well protected using the charging component of the present invention, no image defect was observed after 4,000 applications.

In Comparative Examples 1 and 2, the charging components exhibited significant changes in both the volume resistivity and light and dark potentials when temperature and humidity were reduced, indicating inadequate environmental stability. Striation was observed from both examples at the reduced temperature and humidity condition. Furthermore, both examples showed image defects after about 3,000 printings.

The charging components of Comparative Example 3 exhibited a low volume resistivity, which was also relatively unaffected by the environment. However, the 1-ram pin-hole in the charged component caused striation at both temperatures. Also image defects were observed after less than about 700 printings.

The charging components of Comparison 4 exhibited a low volume resistivity, which was also relatively unaffected by the environment. However, image defects were observed both initially and after about 1,100 (normal condition) and 400 (reduced temperature and humidity condition) printings.

The foregoing description of the preferred embodiment of this invention has been presented for purposes of illustration and description. It is not intended to limit the invention to the precise form disclosed. Obvious modifications or variations are possible in light of the above teaching. The embodiment was chosen and described to provide the best illustration of the principles of this invention and its practical application to thereby enable one of the ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

TABLE 1

| | Composition | Volume Resistivity of Surface layer ($\Omega \cdot$ cm) | Dark Potential (−v) | Light Potential (−v) | Image Defects (First 10 Sheets) | Electric Leakage Caused by Pinholes | Long Term Test |
|---|---|---|---|---|---|---|---|
| Example 1 | polyether-ester-amide block copolymer | (1) $3 \times 10^{11}$ | 521 | 80 | none | none | normal after 4000 sheets |
| | | (2) $5 \times 10^{11}$ | 513 | 85 | none | none | normal after 4000 sheets |
| Comparative Example 1 | Nylon 6-12 | (1) $1 \times 10^{12}$ | 500 | 85 | none | none | image defect after 3100 sheets |
| | | (2) $1 \times 10^{14}$ | 450 | 40 | black striation | none | image defect after 2600 sheets |
| Comparative Example 2 | Nylon 6-66-612 | (1) $9 \times 10^{11}$ | 510 | 85 | none | none | image defect after 3200 sheets |
| | | (2) $3 \times 10^{12}$ | 360 | 30 | black striation | none | image defect after 2800 sheets |
| Comparative Example 3 | Epichlorohydrin Rubber | (1) $6 \times 10^{8}$ | 510 | 100 | none | black striation | image defect after 700 sheets |
| | | (2) $2 \times 10^{9}$ | 505 | 90 | none | black striation | image defect after 400 sheets |
| Comparative Example 4 | Chloroprene rubber | (1) $7 \times 10^{9}$ | 470 | 80 | black striation | none | image defect after 1100 sheets |
| | | (2) $3 \times 10^{10}$ | 490 | 70 | black striation | none | image defect after 400 sheets |

Note:
(1) Measured at normal temperature and humidity (23° C., 65% RH).
(2) Measured at reduced temperature and humidity (15° C., 10% RH).

What is claimed is:

1. A charging component for use in electrophotographic process comprising:

(a) a metal core;

(b) a conductive polymer base layer adjacent to and radially outwardly of said metal core; and (c) a protective surface layer adjacent to and radially outwardly of said conductive polymer base layer, wherein said protective surface layer comprising conductive carbon black particles dispersed in a polyether-ester-amide block copolymer represented by the following structure:

$$HO\left[\underset{\underset{O}{\|}}{C}-PA-\underset{\underset{O}{\|}}{C}-O-PE-O\right]_n H$$

wherein n is an integer; PA is a polyamide chain selected from the group consisting of Nylon 4-6, Nylon 6-9, Nylon 6-10, Nylon 6-12, Nylon 6, and Nylon 12; and PE is a polyether chain selected from the group consisting of polyether diol, polypropyl glycol, polyethylene glycol, polytetramethylene glycol, polycaprolactone diol, and polycarbonate diol.

2. The charging component of claim 1 wherein said protective surface layer further comprises at least one Nylon polymer selected from the group consisting of Nylon 6, Nylon 66, Nylon 6-10, Nylon 11, and Nylon 12.

3. The charging component of claim 1 wherein said protective surface layer has a Shore hardness between Shore D 5 and Shore D 90.

4. The charging component of claim 1 wherein said protective surface layer has a Shore hardness between Shore D 10 and Shore D 50.

5. The charging component of claim 1 wherein said protective surface layer has a volume resistivity between $10^6$ Ohm-cm and $10^{12}$ Ohm-cm.

6. The charging component of claim 1 wherein said protective surface layer has a volume resistivity between $10^8$ Ohm-cm and $10^{11}$ Ohm-cm.

7. A method for charging a charged component via direct contact therewith during an electrophotographic process, said method comprises the steps of:

(a) obtaining a charging component comprising a metal core, a conductive polymer base layer and a protective surface layer, said protective surface layer containing a polyether-ester-amide block copolymer represented by the following structure:

$$HO\left[\underset{\underset{O}{\|}}{C}-PA-\underset{\underset{O}{\|}}{C}-O-PE-O\right]_n H$$

wherein n is an integer; PA a polyamide chain selected from the group consisting of Nylon 4-6, Nylon 6-9, Nylon 6-10, Nylon 6-12, Nylon 6, Nylon 11, and Nylon 12; and PE is a polyether chain selected from the group consisting of polyether diol, polypropyl glycol, polyethylene glycol, polytetramethylene glycol, polycaprolactone diol, and polycarbonate diol;

(b) applying a voltage to said charging component; and (c) bringing said charging component in direct contact with said charged component to cause said charged component to become electrostatically charged.

8. The method of charging a charged component according to claim 7 wherein said protective surface layer having a Shore hardness in the range between Shore D 5 and Shore D 90.

9. The method for charging a charged component according to claim 7 wherein said protective surface layer having a Shore hardness in the range between Shore D 10 and Shore D 50.

10. The method for charging a charged component according to claim 7 wherein said protective surface layer further comprises at least one Nylon polymer selected from the group consisting of Nylon 6, Nylon 66, Nylon 6-10, Nylon 11, and Nylon 12.

11. The method for charging a charged component according to claim 7 wherein said charged component is an photo-conductive drum containing organic photo-conductive material.

12. The method for charging a charged component according to claim 7 wherein said protective surface layer has a volume resistivity between $10^{12}$ Ohm-cm and $10^{12}$ Ohm-cm.

13. The method for charging a charged component according to claim 7 wherein said protective surface layer has a volume resistivity between $10^{8}$ Ohm-cm and $10^{11}$ Ohm-cm.

14. The method for charging a charged component according to claim 7 wherein said voltage is a pulse voltage consisting of a direct voltage of $\pm 200$ V to $\pm 2{,}000$ V overlapped with an alternating voltage of less than 4,000 V.

* * * * *